United States Patent [19]

Helling et al.

[11] Patent Number: 4,756,998

[45] Date of Patent: Jul. 12, 1988

[54] POLYMERIC COUPLERS AND LIGHT-SENSITIVE PHOTOGRAPHIC SILVER HALIDE RECORDING MATERIAL CONTAINING SUCH COUPLERS

[75] Inventors: Günter Helling, Odenthal; Friedrich-Wilhelm Kunitz, Leverkusen; Hans Langen, Bonn, all of Fed. Rep. of Germany

[73] Assignee: Agfa Gevaert Aktiengesellschaft, Leverkusen, Fed. Rep. of Germany

[21] Appl. No.: 915,045

[22] Filed: Oct. 3, 1986

[30] Foreign Application Priority Data

Oct. 15, 1985 [DE] Fed. Rep. of Germany ..... 3536608

[51] Int. Cl.[4] ..... G03C 7/32; G03C 7/26; G03C 1/06

[52] U.S. Cl. ..... 430/548; 430/627; 430/630

[58] Field of Search ..... 430/548, 627, 630, 381

[56] References Cited

U.S. PATENT DOCUMENTS

| | | | |
|---|---|---|---|
| 3,449,126 | 6/1969 | Minsk | 430/627 |
| 3,597,215 | 8/1971 | Abel et al. | 430/627 |
| 4,522,916 | 6/1985 | Hirano | 430/548 |
| 4,663,272 | 5/1987 | Nakamura | 430/542 |

*Primary Examiner*—Paul R. Michl
*Assistant Examiner*—Lee C. Wright
*Attorney, Agent, or Firm*—Connolly and Hutz

[57] ABSTRACT

Polymeric couplers with recurring units which contain at least one urethane and/or urea group, are suitable for the production of improved photographic recording materials.

8 Claims, No Drawings

POLYMERIC COUPLERS AND LIGHT-SENSITIVE PHOTOGRAPHIC SILVER HALIDE RECORDING MATERIAL CONTAINING SUCH COUPLERS

This invention relates to new polymeric couplers and to a photographic silver halide recording material containing such couplers.

It is known that when a light-sensitive photographic silver halide recording material is developed with a p-phenylenediamine, the oxidation product of the developer can be reacted with so-called couplers to form a reaction product which may be coloured. The couplers may be conventional colour couplers, so-called white couplers or DIR compounds.

The couplers are generally used in a diffusion-fast form in the photographic material. It is known to use high molecular weight couplers for this purpose, which may be obtained, for example, by the polymerisation of a monomeric coupler.

High molecular weight colour couplers have been described, for example, in DE-C-No. 1 297 417, DE-A-No. 2 407 569, DE-A-No. 3 148 125, DE-A-No. 3 217 200, DE-A-No. 3 320 079, DE-A-No. 3 324 932, DE-A-No. 3 331 743, DE-A-No. 3 340 376, EP-A-No. 27 284 and U.S. Pat. No. 4,080,211. The high molecular weight colour couplers are generally prepared by the polymerisation of ethylenically unsaturated monomeric colour couplers.

The known polymeric couplers have, however, the following disadvantages:

They have insufficient colloid stability and therefore give rise to the formation of agglomerates in storage. These agglomerates interfere with casting if they exceed a certain size and may then give rise to casting faults in the form of spots or streaks. In addition, large particles tend to sediment in the course of time so that an uncontrollable change takes place in the concentration of latex coupler in the areas capable of coupling. Removal of the agglomerates by filtration causes considerable difficulties due to blockage of the filters.

The absorption of polymeric couplers is frequently not ideal.

4-Equivalent magenta couplers in polymeric form in particular are unstable against the influence of formalin.

It is an object of the present invention to provide improved polymeric couplers and photographic recording materials containing these couplers.

New polymeric couplers and photographic silver halide recording materials containing them have now been found. The new couplers are copolymers containing recurrent units of polymerised monomer K containing a coupler group and recurrent units of a polymerised monomer M different from the monomer K, characterised in that the monomer M contains at least one urethane and/or urea group.

In a preferred embodiment, the monomer M is different from the monomer K by not containing any coupling groups.

In a preferred embodiment the monomer M corresponds to at least one of the following formulae 1 to 3:

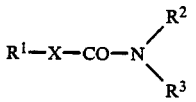

(1)

-continued

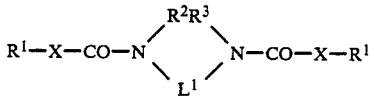

(2)

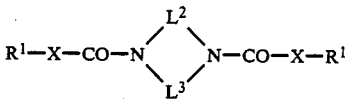

(3)

wherein

X denotes —O— or —$NR^4$—;

$R^1$ to $R^4$, which may be identical or different, denote H, substituted or unsubstituted alkyl with 1 to 20 carbon atoms, substituted or unsubstituted cycloalkyl, substituted or unsubstituted cycloalkyl, substituted or unsubstituted aralkyl or a heterocyclic group and $R^2$ and $R^3$ or $R^2$ and $R^4$ and/or $R^3$ and $R^4$ may together represent the group required for forming a heterocyclic group, and at least one of the groups $R^1$, $R^2$, $R^3$ and $R^4$ contains an ethylenically unsaturated group;

$L^1$ denotes a substituted or unsubstituted alkylene, arylene or aralkylene having a maximum of 18 carbon atoms; and $L^2$ and $L^3$, which may be identical or different, denote substituted or unsubstituted alkylene groups having a maximum of 10 carbon atoms.

In a preferred embodiment, the group $R^1$ to $R^4$ containing an ethylenically unsaturated group corresponds to the following formula

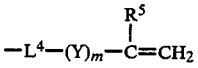

(4)

wherein $L^4$ denotes a conventional organic connecting member, in particular a substituted or unsubstituted alkylene, arylene or aralkylene group having a maximum of 18 carbon atoms;

Y denotes a divalent connecting member having at least one hetero atom, in particular —O—CO—, —$NR^6$—CO— or —CO—$NR^6$—;

m represents 0 or 1;

$R^5$ denotes hydrogen, alkyl, in particular with 1 to 4 carbon atoms, or halogen, in particular chlorine; and $R^6$ denotes hydrogen or alkyl, in particular with 1 to 4 carbon atoms.

The substituents for the alkylene group, the aralkylene group or the phenylene group $R^1$ to $R^4$ may include an aryl group (for example a phenyl group, etc.) a nitro group, a hydroxyl group, a cyano group, a sulpho group, an alkoxy group (for example, a methoxy group, etc.), an aryloxy group (for example, a phenoxy group, etc.) an acyloxy group (for example, an acetoxy group, etc.), an acylamino group (for example, an acetylamino group, etc.), a sulphonamido group (for example, a methanesulphonamide group, etc.), a sulphamoyl group (for example, a methylsulphamoyl group, etc.), a halogen atom (for example, a fluorine atom, a chlorine atom, a bromine atom, etc.), a carboxyl group, a carbamoyl groups (for example, a methylcarbamoyl group, etc.), an alkoxycarbonyl group, (for example, a methoxycarbonyl group, etc.), a sulphonyl group (for example a methylsulphonyl group, etc.), a sulphonic acid group, or the like. When two or more substituents are present, they may be identical or different.

Examples of monomers M are represented in Table 1 below:

TABLE 1

M1

$$CH_2{=}C(CH_3){-}COO{-}CH_2{-}CH_2{-}NH{-}CO{-}NH{-}C_4H_9$$

M2

$$CH_2{=}C(CH_3){-}COO{-}CH_2{-}CH_2{-}NH{-}CO{-}NH{-}C_2H_5$$

M3

$$CH_2{=}CH{-}COO{-}CH_2{-}CH_2{-}O{-}CO{-}NH{-}C_3H_7$$

M4

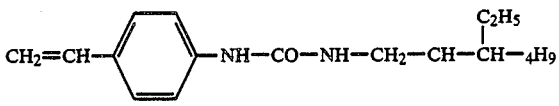

M5

$$CH_2{=}CH{-}CH_2{-}NH{-}CO{-}NH_2$$

M6

$$CH_2{=}C(CH_3){-}COO{-}CH_2{-}CH_2{-}CH_2{-}O{-}C(=O){-}NH{-}CH_3$$

M7

$$CH_2{=}C(CH_3){-}CONH{-}CH_2{-}CH_2{-}CH_2{-}CH_2{-}N(H){-}CO{-}NH_2$$

M8

$$CH_2{=}CH{-}CONH{-}CH_2{-}CH_2{-}CH_2{-}O{-}C(=O){-}NH{-}C_{12}H_{25}$$

M9

$$CH_2{=}CH{-}COO{-}CH_2{-}CH_2{-}NH{-}CO{-}N(CH_3){-}CH_2{-}CH_2{-}OH$$

M10

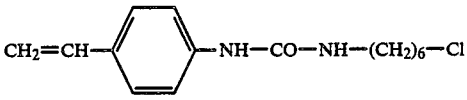

M11

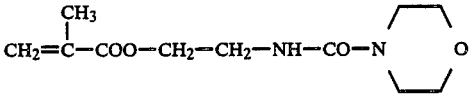

M12

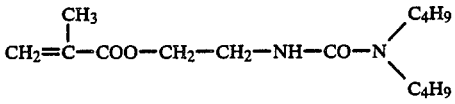

M13

$$CH_2{=}C(CH_3){-}COO{-}CH_2{-}CH_2{-}NH{-}CO{-}NH_2$$

M14

$$CH_2{=}C(CH_3){-}COO{-}CH_2{-}CH_2{-}NH{-}CO{-}NH{-}CH_2{-}CH{=}CH_2$$

M15

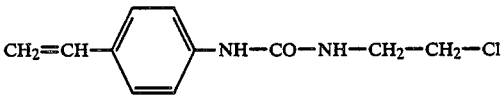

M16

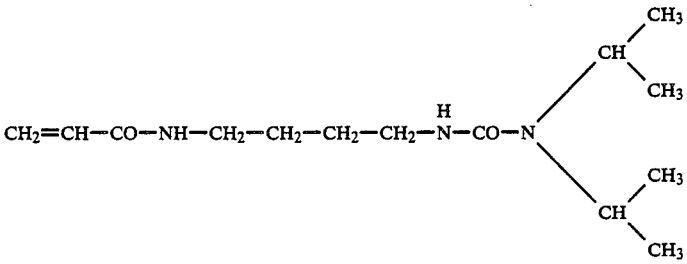

TABLE 1-continued
M17
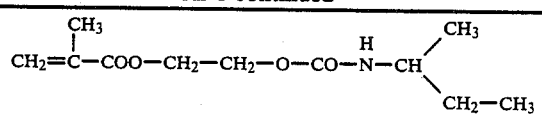
M18
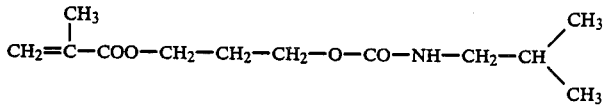
M19
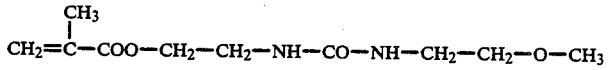
M20
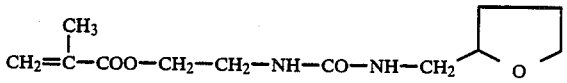
M21
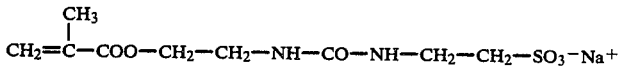
M22
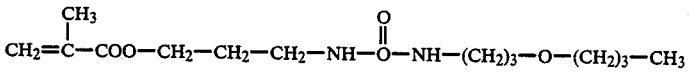
M23
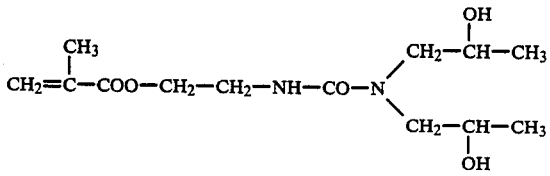
M24
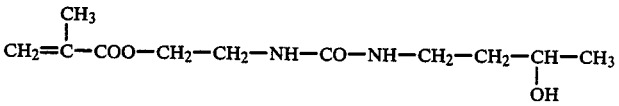
M25
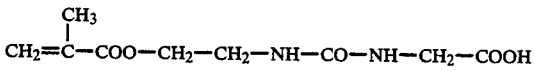
M26
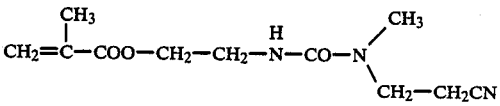
M27
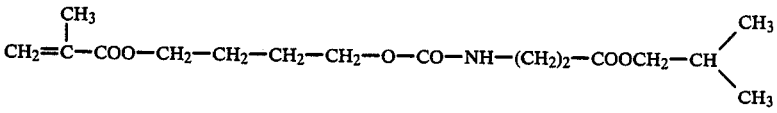
M28
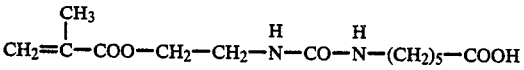
M29
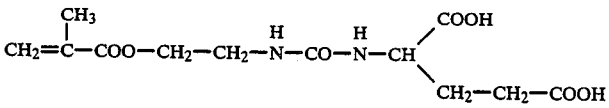
M30
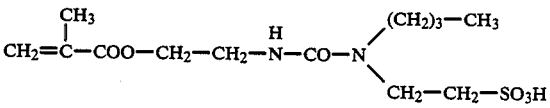
M31
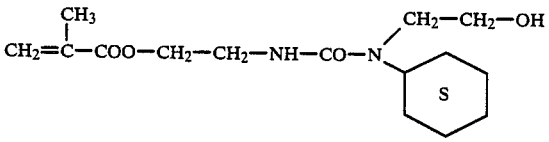

TABLE 1-continued
M32
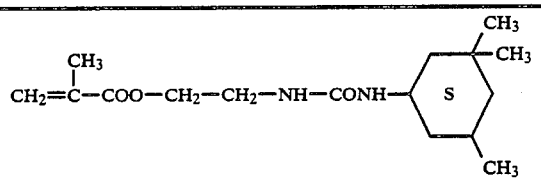
M33
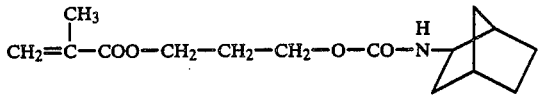
M34
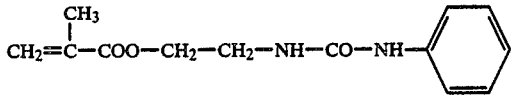
M35
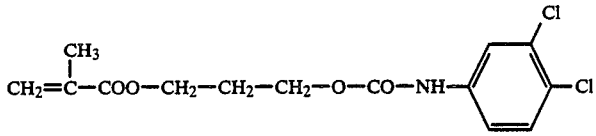
M36
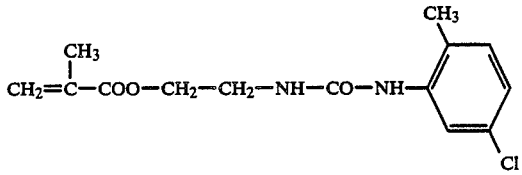
M37
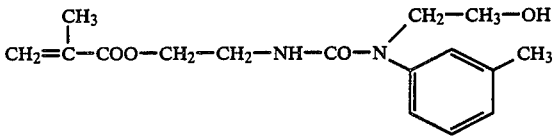
M38
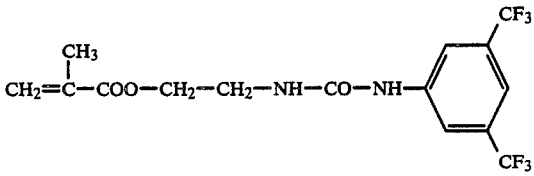
M39
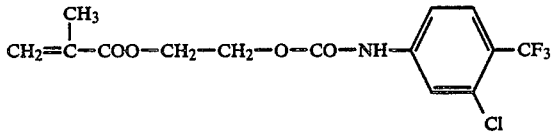
M40
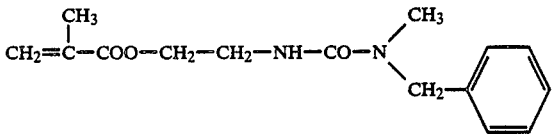
M41
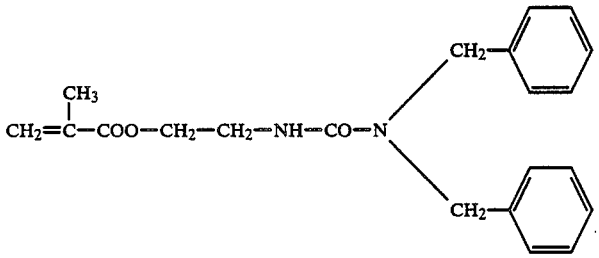

TABLE 1-continued
M42
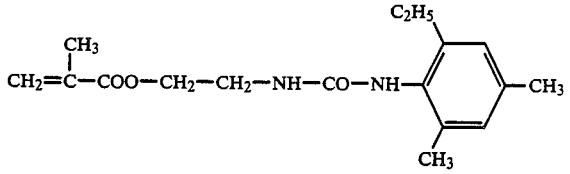
M43
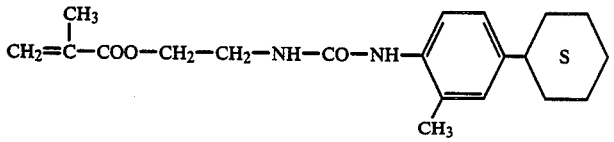
M44
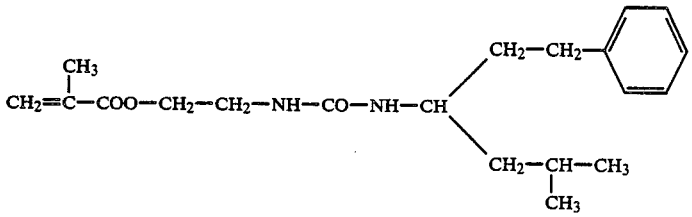
M45
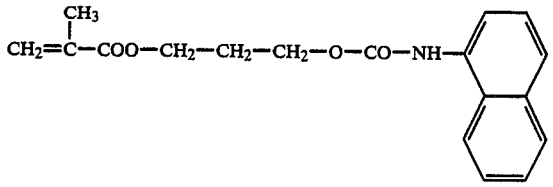
M46
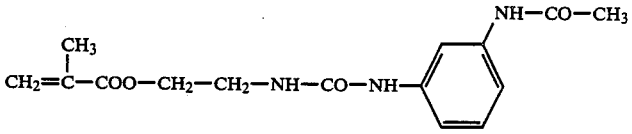
M47
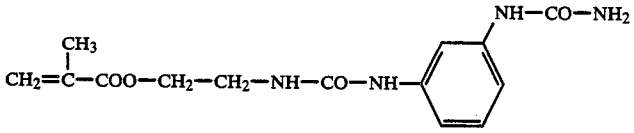
M48
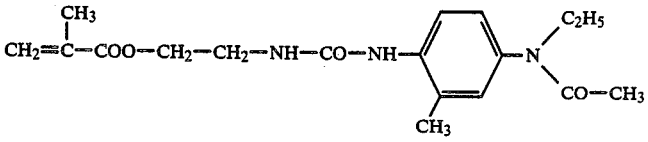
M49
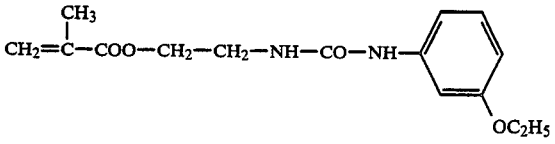
M50
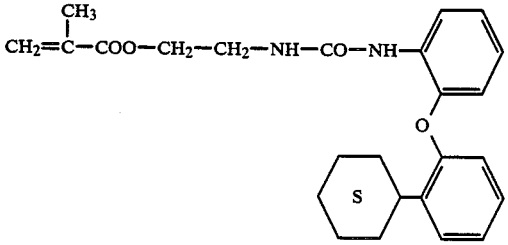

TABLE 1-continued
M51
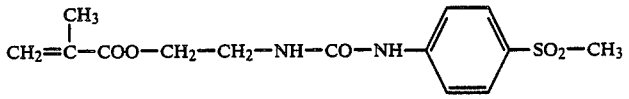
M52
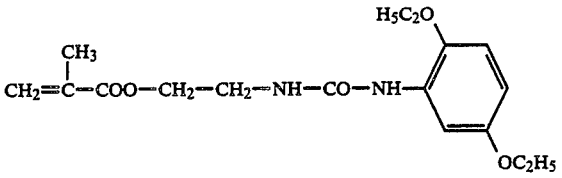
M53
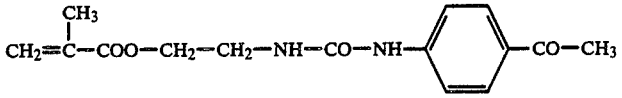
M54
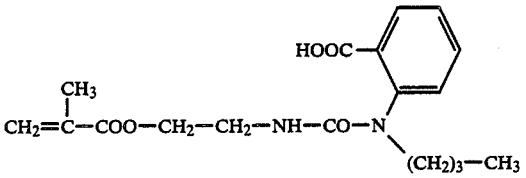
M55
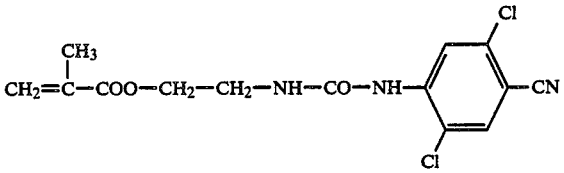
M56
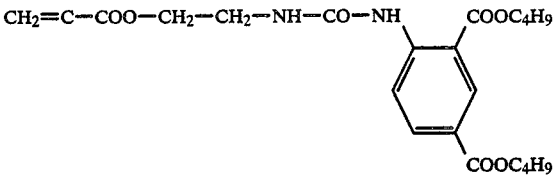
M57
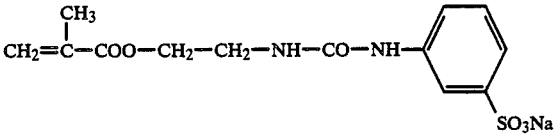
M58
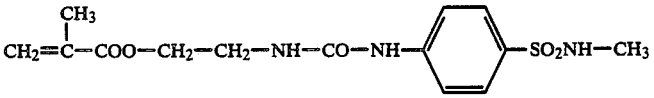
M59
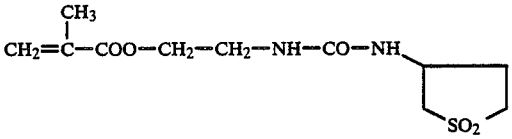
M60
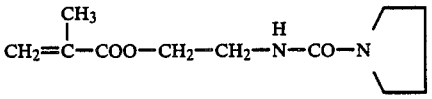
M61
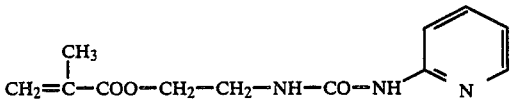

TABLE 1-continued
M62
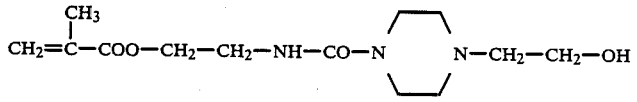
M63
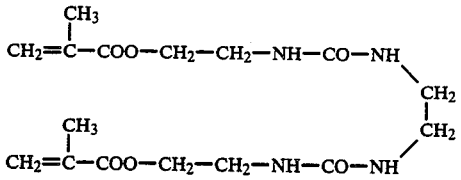
M64
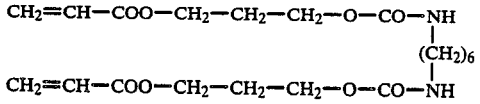
M65
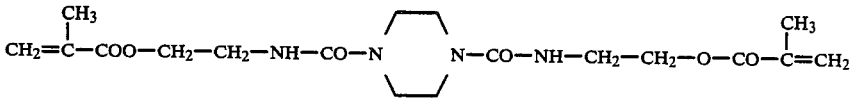
M66
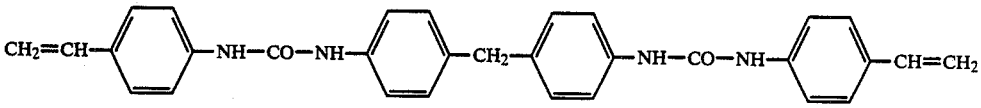
M67
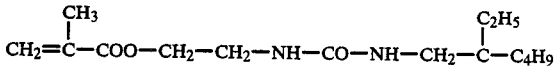
M68
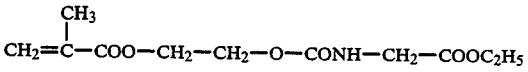
M69
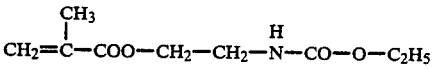
M70
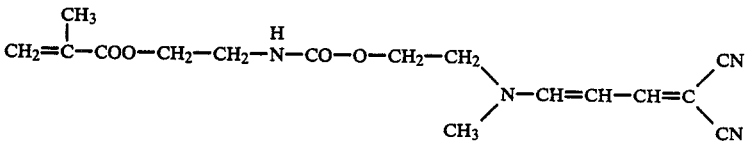
M71
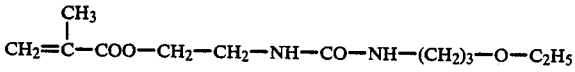
M72
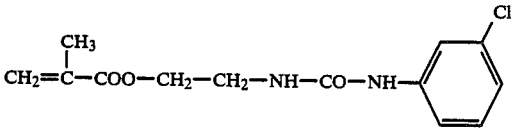
M73
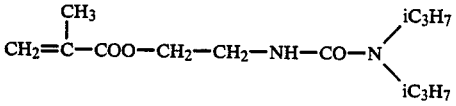
M74
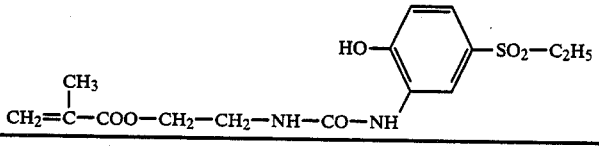
in which rings marked by "S" are saturated rings.
Known ethylenically unsaturated compounds containing a coloured or colourless coupling group may be used as monomeric couplers K. Monomeric couplers are described, for example, in DE No. 1 908 674, DE No. 24 123, DE No. 3 317 200, DE No. 3 148 125, DE No. 3 300 665, DE No. 3 214 567, DE No. 3 226 163, DE No. 3 305 718, DE No. 3 221 883, DE No. 2 725 591, EP No. 3 401 455, DE-PS No. 1 297 471, DE-PS No. 1 570 672, DE No. 2 407 569, EP No. 27 284, DE No. 3 331 743, DE No. 3 336 582, EP No. 136 924, DE No. 3 432 396 and EP No. 0 133 262.

In a preferred embodiment, the monomers K containing couplers correspond to the following formula

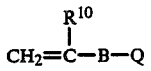

(5)

wherein $R^{10}$ denotes hydrogen, alkyl, in particular with 1 to 4 carbon atoms, or halogen, in particular chlorine, B denotes an organic connecting group of the kind commonly used in polymeric couplers and Q denotes a coupler residue, in particular of a colour coupler, a white coupler or a DIR compound.

In a particularly preferred embodiment, the coupler-containing monomer K corresponds to the following formula

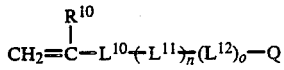

(6)

wherein $R^{10}$ denotes hydrogen, alkyl, in particular with 1 to 4 carbon atoms, or halogen, in particular chlorine, $L^{10}$ denotes —CO—NH—, —COO—, —O— or phenylene.

$L^{11}$ denotes a conventional organic connecting member, in particular a substituted or unsubstituted alkylene, arylene or aralkylene group with a maximum of 18 carbon atoms, $L^{12}$ denotes —CO—O—, —OC—O—, —CO—NH—, —NHCO—, —$SO_2$NH—, —NH$SO_2$—, —NH—CO—O— or —NHCONH—, n and o, which may be identical or different, represent 0 or 1 and Q denotes the residue of a coupler, in particular of a colour coupler, a white coupler or a DIR compound.

The term "couplers" is used in the context of the present invention to denote compounds which react with the oxidation product of a colour developer to form or release an optionally coloured organic compound.

Examples of particularly preferred monomers K containing couplers are shown in Table 2 below:

TABLE 2

K1

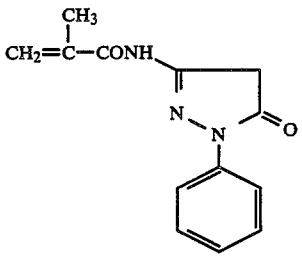

K2

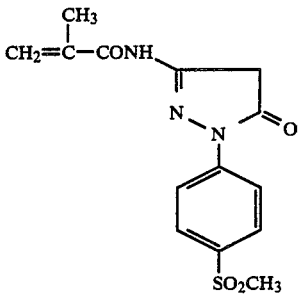

K3

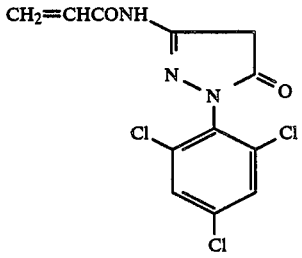

K4

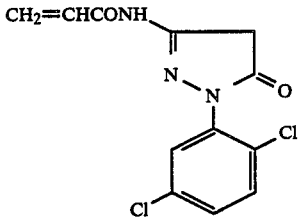

K5

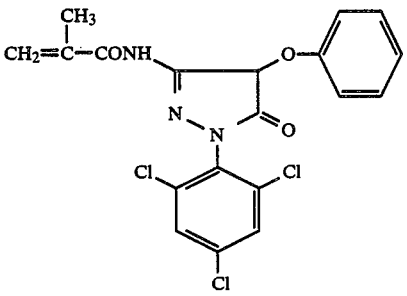

K6

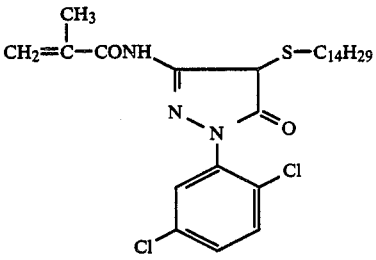

TABLE 2-continued
K7
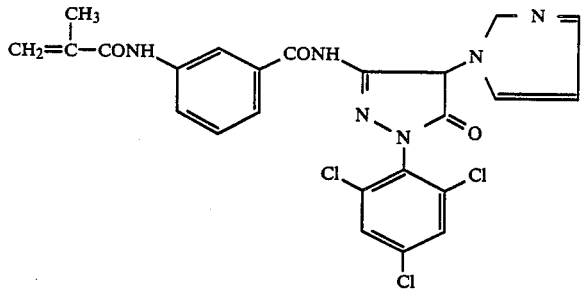
K8
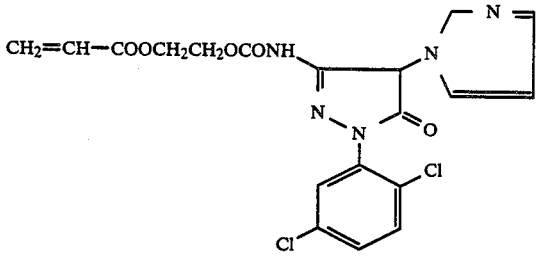
K9
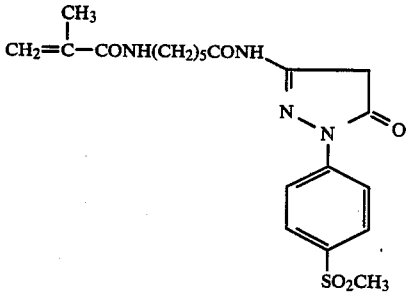
K10
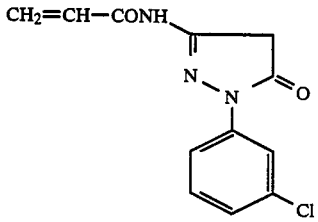
K11
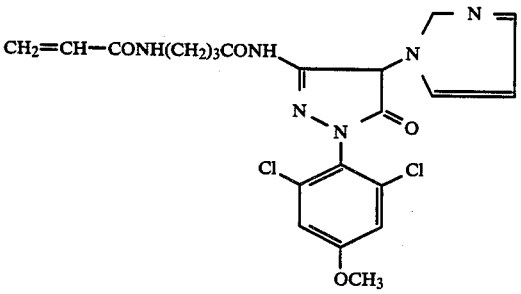
K12
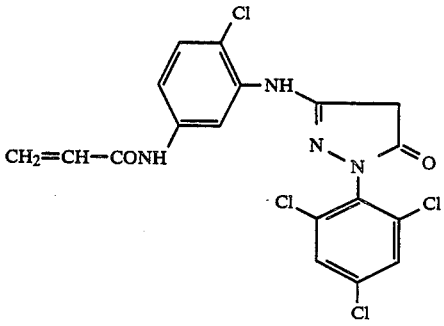
K13
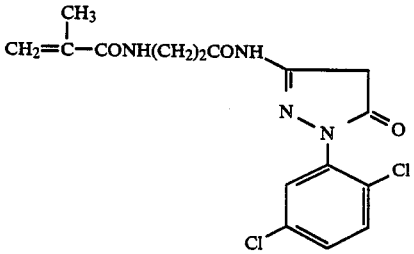
K14
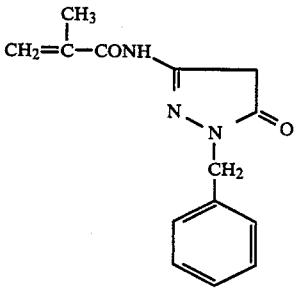

TABLE 2-continued
K15
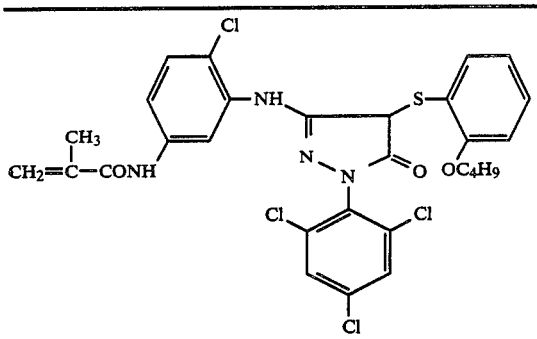
K16
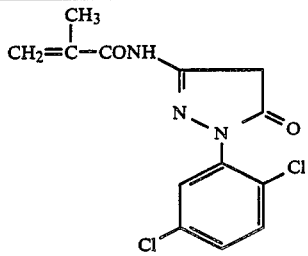
K17
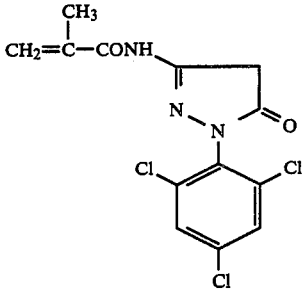
K18
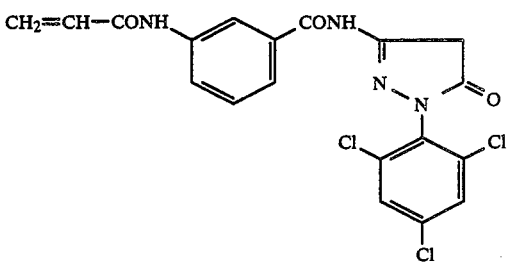
K19
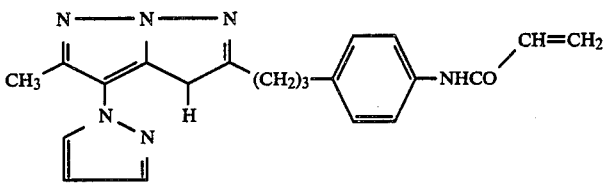
K20
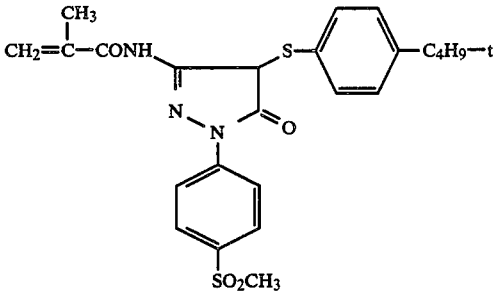
K21
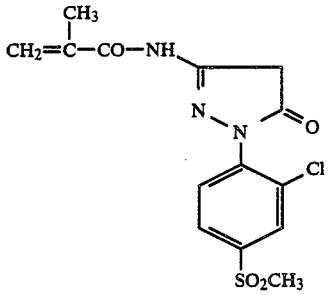
K22
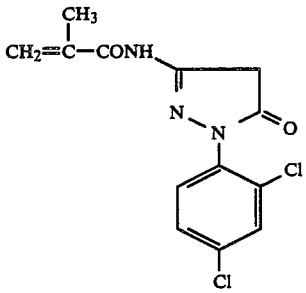
K23
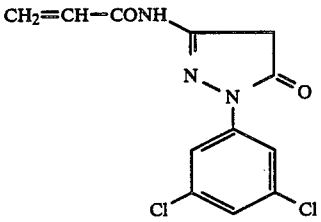
K24
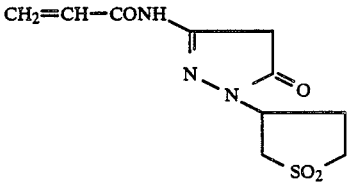
K25
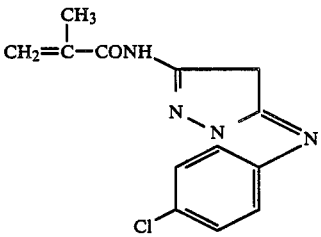

TABLE 2-continued
K26
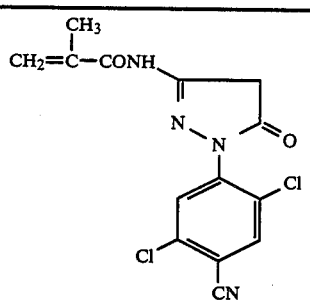
K27
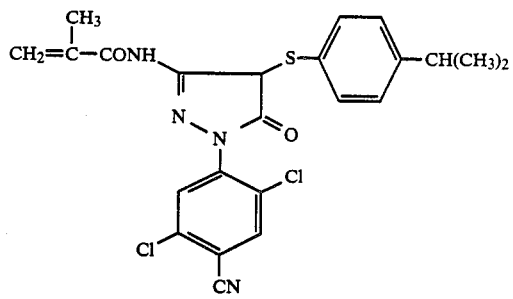
K27a
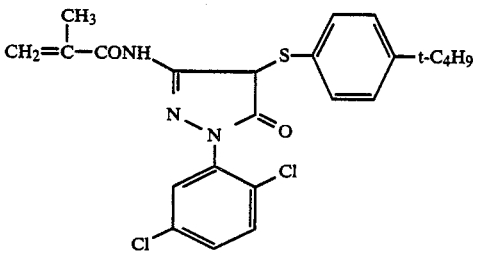
K28
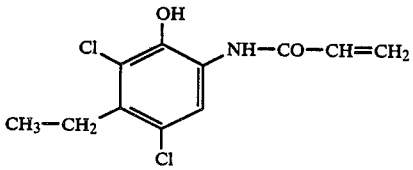
K29
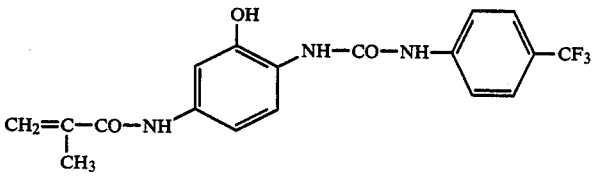
K30
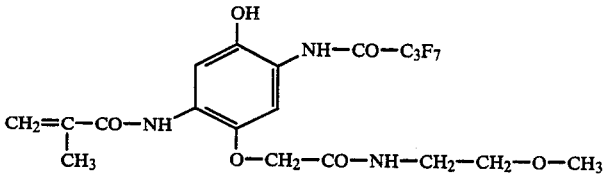
K31
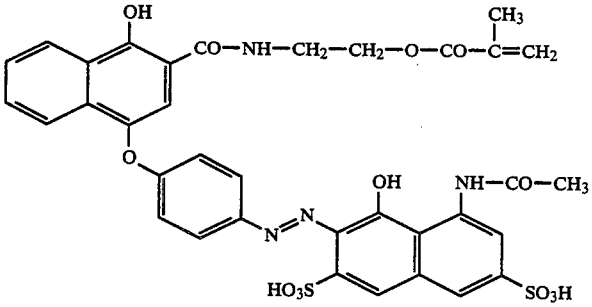
K32
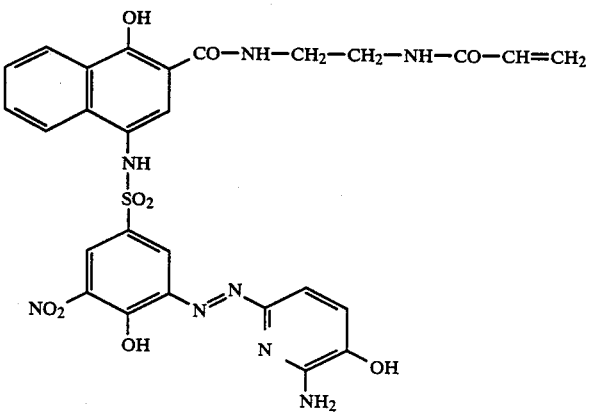

TABLE 2-continued
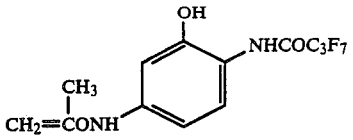
K33
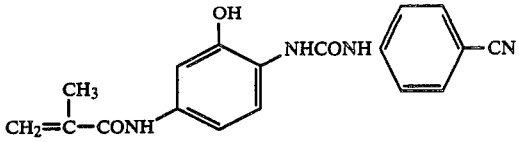
K34
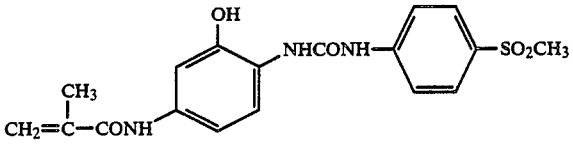
K35
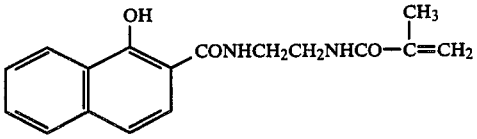
K36
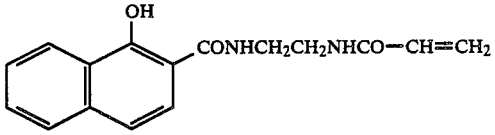
K37
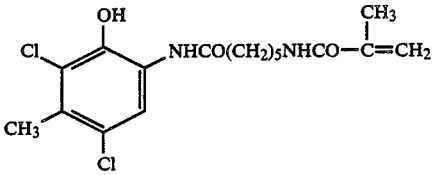
K38
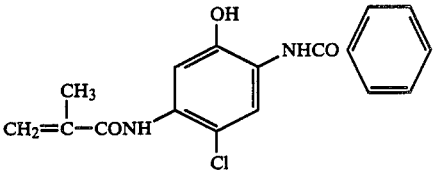
K39
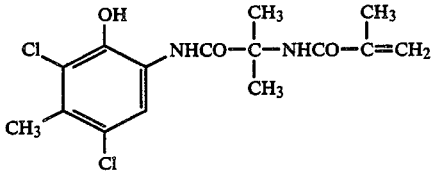
K40
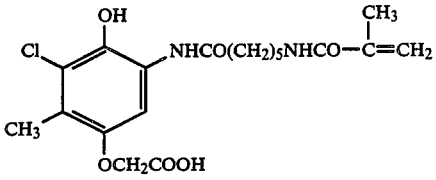
K41
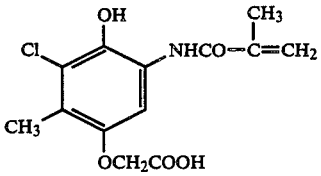
K42
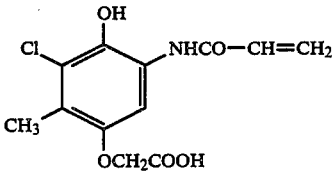
K43
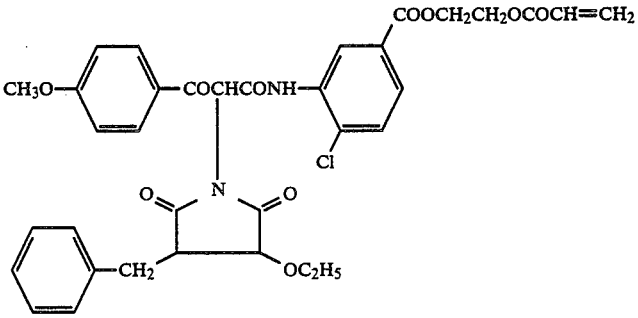
K44

TABLE 2-continued
K45
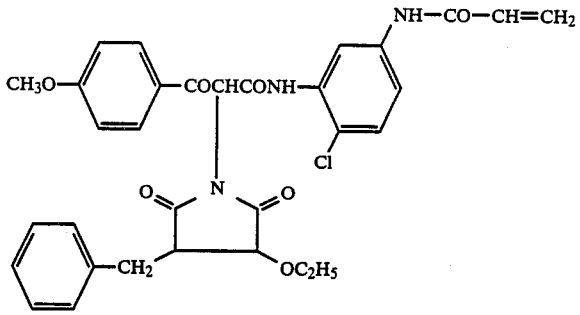
K46
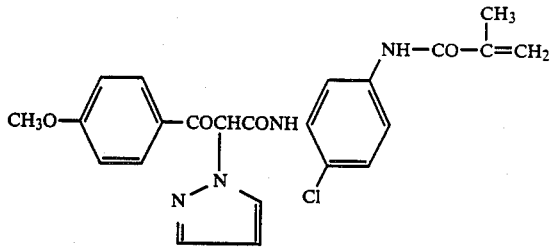
K47
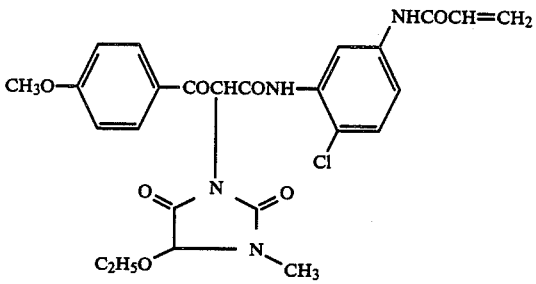
K48
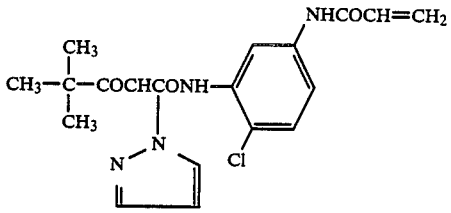
K49
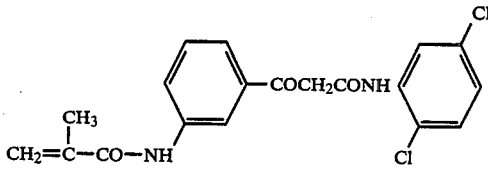
K50
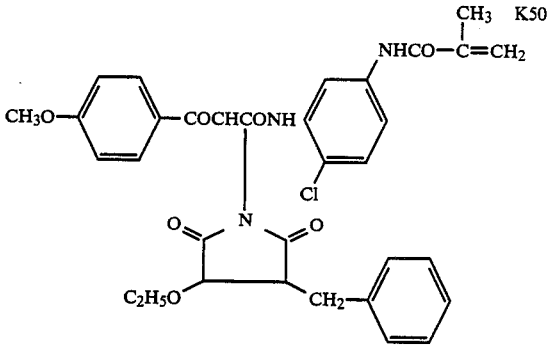
K51
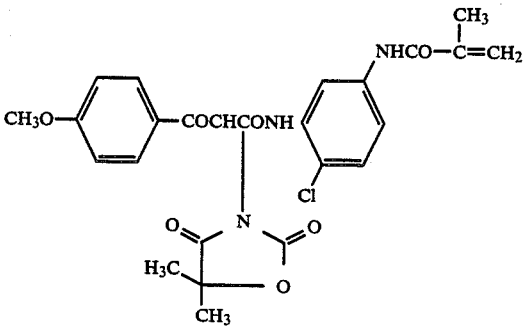
K52
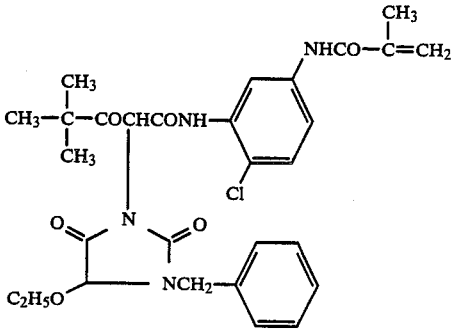
K53
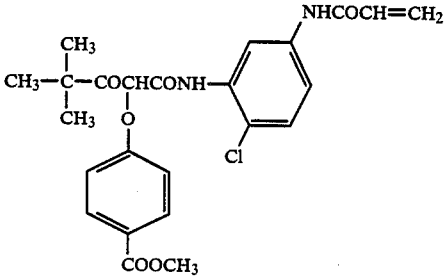
K54
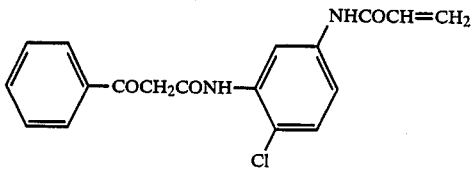

TABLE 2-continued
K55
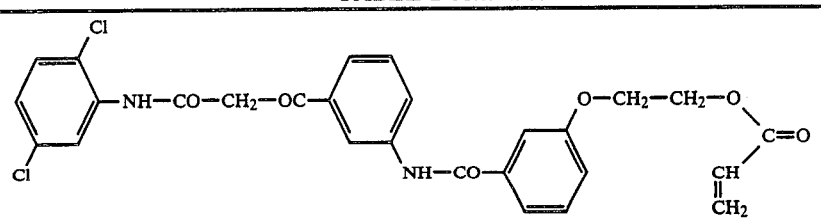
K56
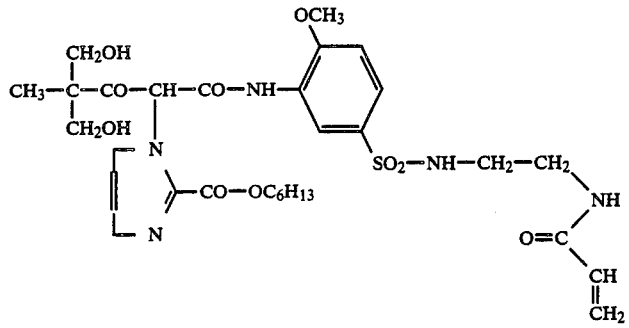
K57
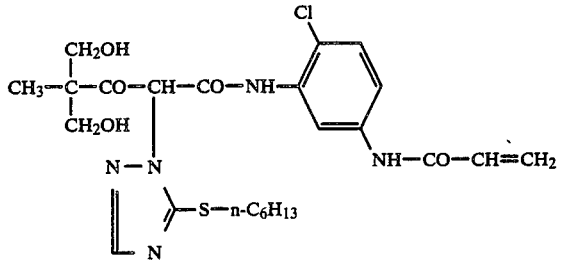
K58
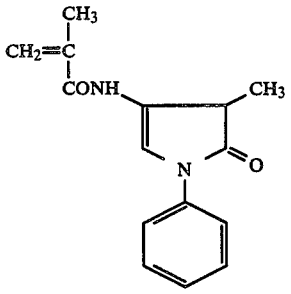
K59
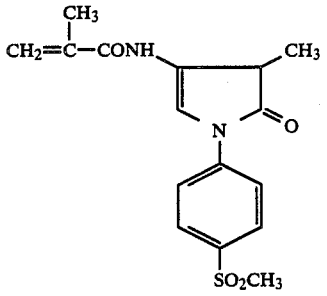
K60
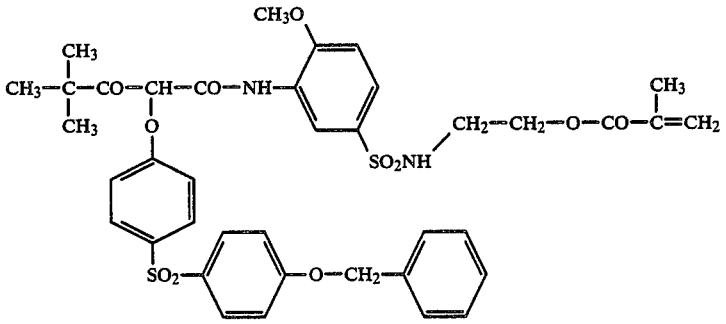
K61
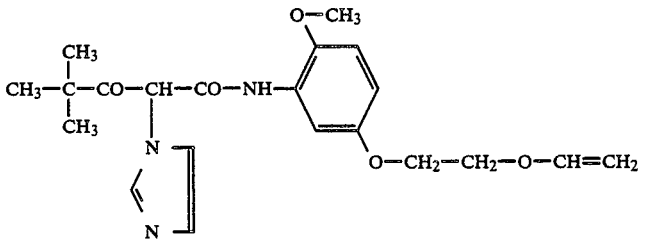

TABLE 2-continued
K62
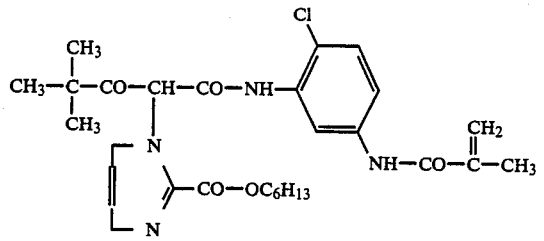
K63
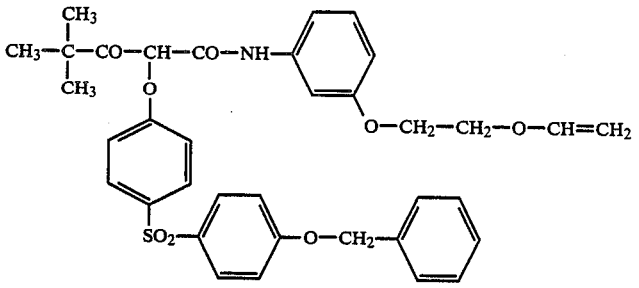
K64
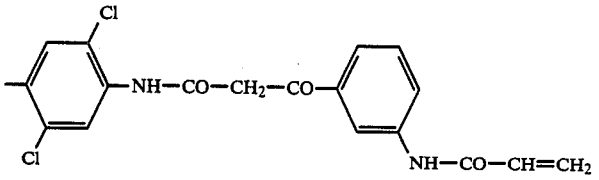
K65
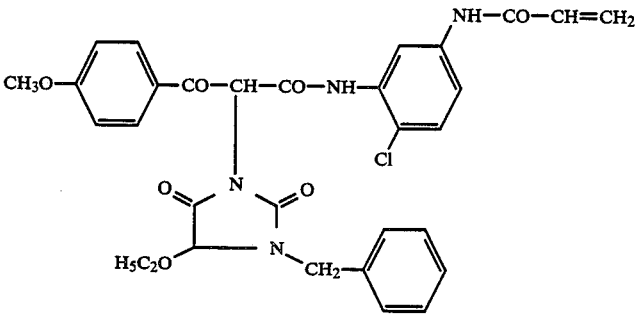
K66
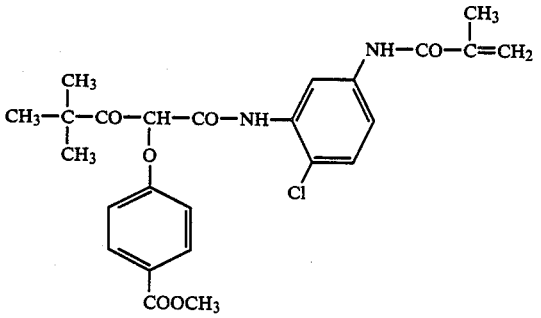

TABLE 2-continued
K67
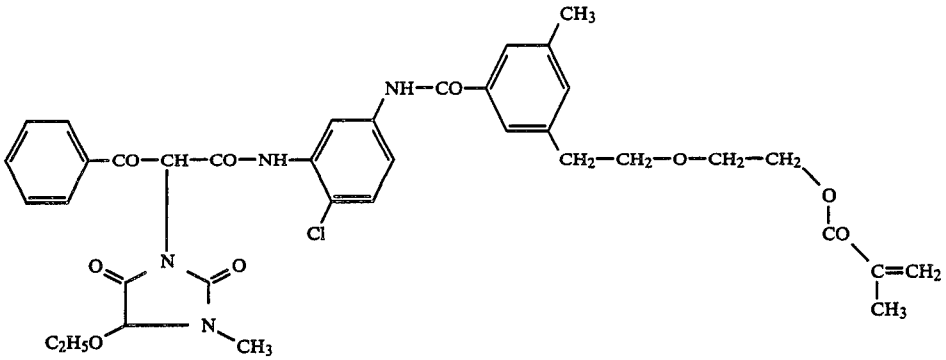
K68
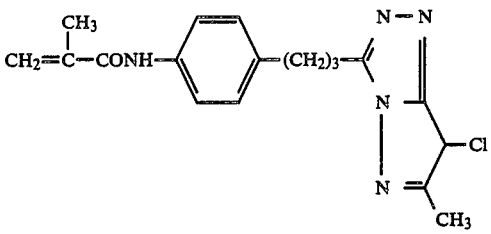
K69
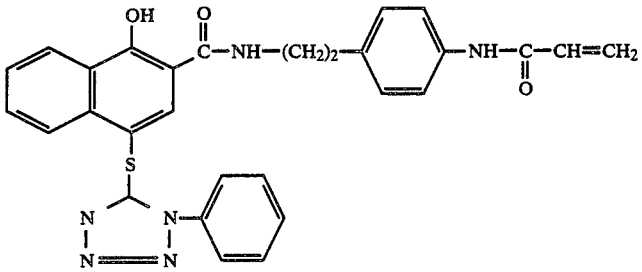
K70
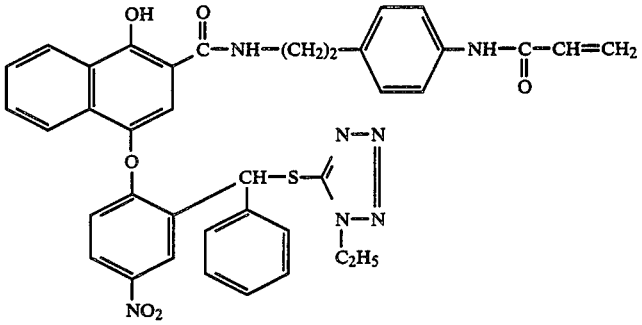
K71
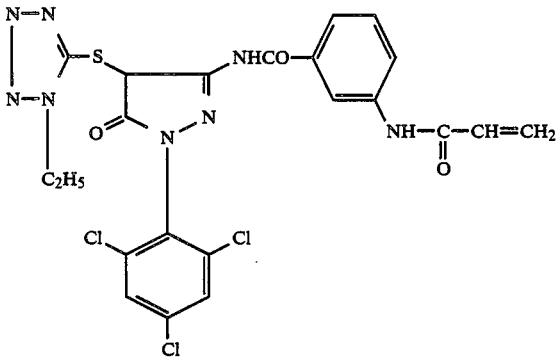
K72
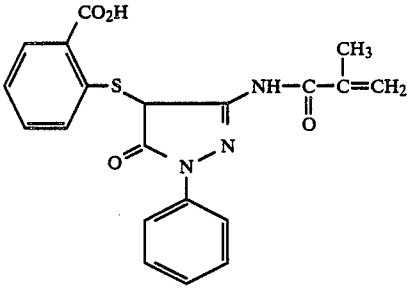

TABLE 2-continued

K73

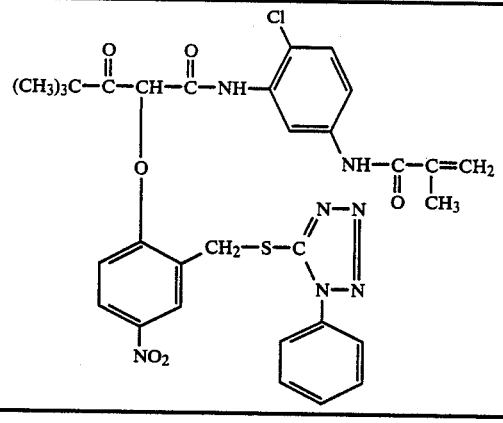

K74

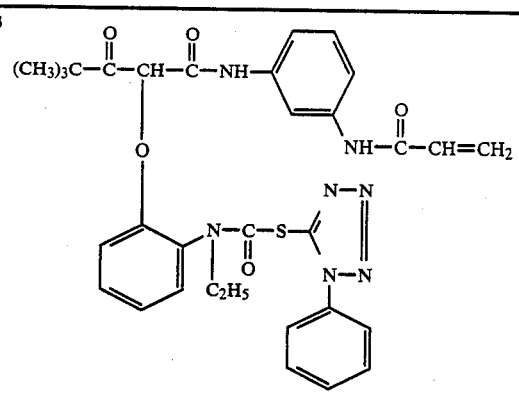

The proportion of coupler-containing monomer K in the copolymer generally amounts to 20 to 70% by weight, preferably 25 to 50% by weight, and the proportion of monomer M generally amounts to 50 to 80% by weight, preferably 5 to 50% by weight.

Preparation of the monomer M may be carried out, for example, by the reaction of a monomer containing isocyanate groups with a compound containing amino or hydroxyl groups. Alternatively, the monomer M may be prepared by the reaction of monomers containing an amino or hydroxyl group with an isocyanate or a chloroformic acid ester, or they may be prepared by reacting a compound already containing a urea or urethane group with a reactive monomer.

Various reactions for the synthesis of some of the monomers shown in Table 1 are indicated in the following reaction schemes:

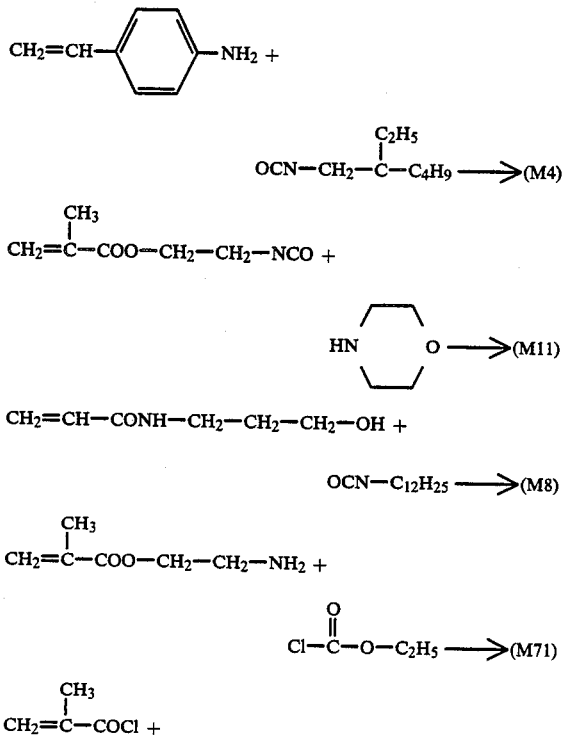

-continued

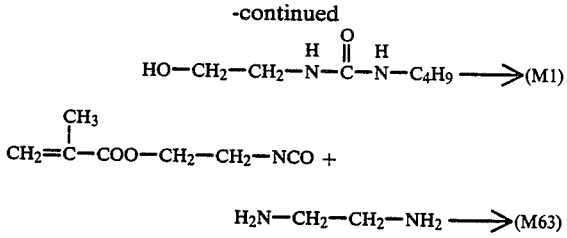

The synthesis of M1 and of M70 as examples of a urea and a urethane monomer is described below.

Monomer M1

7.3 g of n-Butylamine are dissolved in 20 ml of i-octane and cooled to 0° C. 14.1 g of Isocyanatoethylmethacrylate are slowly added dropwise at 0° to 5° C. The reaction mixture is then diluted with 20 ml of i-octane and stirred for a further 15 minutes. The product obtained is separated by suction filtration, washed with i-octane and dried.

Yield: 80%.

Melting point: 59° C.

Monomer M70

36 g of 3-(N-Methyl-N-2-hydroxyethyl)-aminoalkylidenemalonitrile are stirred together with 31 g of isocyanatoethyl-methacrylate in 250 ml of ethyl acetate for 3 hours at 25° to 30° C. with the addition of 1 g of 1,4-diazabicyclo-[2,2,2]-octane and 0.5 g of ionol (2,6-di-tert.-butyl-4-methylphenol) and the reaction mixture is then left to stand overnight. The solution is concentrated by evaporation under vacuum and the yellowish residue is dissolved in 70 ml of methanol at 30° C. with the addition of 0.5 g of ionol and then cooled to 0° C. The precipitate obtained is filtered off and dried under vacuum at room temperature. 34 g of a yellowish product melting at 73° to 74° C. are obtained.

The polymers according to the invention may contain other copolymerised monomers C in addition to the recurrent units of coupler-containing monomers K and the monomers M. Examples of such comonomers C include esters, preferably lower alkyl esters, and amides derived from an acrylic acid, for example acrylic acid, an α-chloroacrylic acid, an alkyl acrylic acid such as methacrylic acid, etc. (examples: acrylamide, methyl methacrylate, ethyl acrylate, ethylmethacrylate, n-propyl acrylate, n-butyl acrylate, 2-ethylhexyl acrylate, n-hexyl acrylate, octyl methacrylate, lauryl methacrylate and methylene-bis-acrylamide, etc.), a vinyl ester (for example, vinyl acetate, vinyl propionate, vinyl laurate, etc.), acrylonitrile, methacrylonitrile, an aromatic vinyl compound (for example, styrene and a derivative thereof such as vinyl toluene, divinylbenzene, vinyl acetophenone, sulphostyrene, styrene sulphonic acid, etc.), itaconic acid, citraconic acid, crotonic acid, vinylidene chloride, a vinyl alkyl ether (for example, vinyl ethyl ether, etc.), an ester of maleic acid, N-vinyl-2-pyrrolidone, N-vinyl pyridine, 2- and 4-vinyl pyridine, etc.

The molecular weights of the compounds according to the invention are preferably greater than 5000, in particular greater than 20,000 in order to ensure sufficient resistance to diffusion. The upper limit is not critical and may reach values above 10 million, especially if bifunctional or polyfunctional monomers are used as additional comonomers C.

It is particularly preferred if these monomers C are esters of acrylic acid, esters of methacrylic acid or aromatic vinyl compounds.

Two or more of the comonomer compounds C described above may be used together. For example, a combination of n-butyl acrylate and divinylbenzene, of styrene and methyl methacrylate or of methyl acrylate and methacrylic acid, etc. may be used.

The ethylenically unsaturated monomer C may be so chosen that it will have an advantageous influence on the physical properties and/or chemical properties of the copolymer to be prepared, for example its solubility, compatibility with a binder such as gelatine used in the photographic colloid composition or with other substances absorbing ultraviolet radiation, or with known photographic antioxidants or known colour producing agents, or the flexibility or thermal stability, etc.

In a preferred embodiment, the polymers according to the invention are used as polymer dispersions or as a polymer latex.

The polymer latex according to the invention may be prepared by a process of emulsion polymerisation or by polymerisation of a monomer in an organic solvent followed by dispersion of the solution in latex form in an aqueous solution of gelatine.

The free radical polymerisation of an ethylenically unsaturated monomer is initiated by the addition of a free radical which is formed by thermal decomposition of a chemical initiator, by the action of a reducing agent on an oxidizing compound (redox initiator) or by physical action such as radiation with ultraviolet rays or other high energy radiation, high frequencies, etc.

Examples of the main chemical initiators include persulphates (for example, ammonium persulphate or potassium persulphate, etc.), hydrogen peroxide, peroxides (for example, benzoyl peroxide or tert.-butyl peroctoate, etc.) and azonitrile compounds (for example, 4,4'-azo-bis-4-cyanovaleric acid, azo-bis-isobutyronitrile, etc.), etc.

Examples of conventional redox initiators include hydrogenperoxide-iron (II) salts, potassium persulphate, sodium metabisulphite, cerium-IV-salt-alcohol, etc.

Examples of initiators and their functions are described by F. A. Bovey, in Emulsion Polymerisation, Interscience Publishers Inc., New York, 1955, pages 59 to 93.

The emulsifier used for emulsion polymerisation may be a compound which has a surface-active action. Preferred examples include soaps, sulphonates, sulphates, cationic compounds, amphoteric compounds and high molecular weight protective colloids. Specific examples of emulsifiers and their functions are described in Belgische Chemische Industrie, Vol. 28, pages 16 to 20, 1963.

In another form of application, the polymer is dispersed. If the polymer of formula (I) is dispersed in an aqueous gelatine solution in the form of a latex, organic solvent used for dissolving it may be removed from the mixture before a coating is formed from the dispersion.

The solvents used may be to some extent soluble in water so that they can be washed off with water as gelatine shreds or they may be of the kind which can be removed by spray drying or vacuum or steam washing.

Organic solvents which can be removed also include esters (for example, lower alkyl esters, etc.), lower alkyl ethers, ketones, halogenated hydrocarbons (for example, methylene chloride, trichloroethylene, etc.), fluorinated hydrocarbons, alcohols (for example, methyl alcohol up to butyl alcohol) and combinations thereof.

Any type of dispersing agent may be used for dispersing the hydrophobic polymeric agent which absorbs ultraviolet radiation but ionic and surface-active agents are preferred, especially anionic surface-active agents.

Ampholytic surface-active agents such as C-cetyl betaine, N-alkylaminopropionates, N-alkyliminodipropionates, etc. may also be used.

A small quantity (not more than 50% by weight of the recurrent units of formula (I)) of a permanent solvent, that is to say an organic solvent with a high boiling point (i.e. above 200° C.) which is immiscible with water, e.g. dibutylphosphate and/or tricresylphosphate, etc. may be added to improve the stability of dispersion and the flexibility of the layer of cast emulsion on the photographic material. The concentration of permanent solvent should be sufficiently low to plasticize the polymer while it is kept in a state of solid particles. Furthermore, if a permanent solvent is used, its quantity is preferably as small as possible in order to keep the thickness of the finished emulsion layer or hydrophilic colloid layer sufficiently low so that a sharp image may be obtained.

The light-sensitive silver halide emulsion layers preferably have colour couplers associated with them, which react with colour developer oxidation products to form a non-diffusible dye. The colour couplers are advantageously accommodated in a non-diffusible form in the light-sensitive layer or closely adjacent thereto. At least one light-sensitive silver halide emulsion layer has a copolymer C according to the invention associated with it as a colour coupler, but this layer may in addition have other colour couplers associated with it.

Thus, the red-sensitive layer, for example, may contain a non-diffusible colour coupler for producing the cyan partial colour image, generally a coupler of the phenol or $\alpha$-naphthol series; the green-sensitive layer, for example, may contain at least one non-diffusible colour coupler to produce the magenta partial colour image, colour couplers of the 5-pyrazolone series being generally used for this purpose; the blue-sensitive layer, for example, may contain at least one non-diffusible colour coupler for producing the yellow partial colour image, generally a colour coupler having an open chain keto methylene group. The colour couplers may be, for example, 6-, 4- or 2-equivalent couplers. Suitable couplers have been disclosed, for example, in the publication "Farbkuppler" by W. Pelz in "Mitteilungen aus den Forschungslaboratorien der Agfa, Leverkusen/München", Volume III, page 111 (1961) and K. Venkataraman in "The Chemistry of Synthetic Dyes", Volume 4, 341 to 387, Academic Press (1971) and T. H. James, "The Theory of the Photographic Process", 4th Edition, pages 353–362, and the Journal, Research Disclosure No. 17643 of December 1978, Section VII, published by Industrial Opportunities Ltd., Homewell Havant, Hampshire, PO9 1EF, Great Britain. It may in some cases be advantageous if the couplers used or the dyes formed from them are to some extent diffusible. The usual masking couplers may be used for improving colour reproduction. The photographic recording material may also contain DIR compounds and white couplers which do not give rise to a dye when they react with colour developer oxidation products. The inhibitors released from the DIR compounds may be split off either directly or as non-inhibitory intermediate compounds; see GB No. 953 454, U.S. Pat. No. 3,632,354, U.S. Pat. No. 4,248,962, GB No. 2 072 363 and Research Disclosure No. 10226 of October 1972.

Layers having the same spectral sensitivity may be split up into individual layers which differ in their sensitivity, as described, for example, in DE-A No. 1 958 709 and DE-A No. 2 622 922.

In addition to the layers already mentioned above, the colour photographic recording material according to the invention may contain other layers in the form of light-insensitive auxiliary layers, e.g. bonding layers, anti-halation layers or covering layers or in particular interlayers between the light-sensitive layers to prevent diffusion of developer oxidation products from one layer to another.

The halide contained in the light-sensitive silver halide emulsions may consist of chloride, bromide, iodide or mixtures thereof. In a preferred embodiment, the halide content of at least one layer is composed of 0 to 12 mol-% of AgI, 0 to 50 mol-% of AgCl and 50 to 100% of AgBr. In a preferred embodiment, the halides are predominantly in the form of compact crystals which may have, for example, cubic, octahedric or transition forms. They can be characterised in that they mainly have a thickness of more than 0.2 μm. The average ratio of diameter to thickness is preferably less than 8:1, the diameter of a grain being defined as the diameter of a circle the area of which is equal to the area of the projected surface of the grain. In another preferred embodiment, all or some of the emulsions may contain mainly tabular silver halide crystals in which the ratio of diameter to thickness is greater than 8:1.

The emulsions may be chemically sensitized. The usual sensitizing agents are suitable for chemically sensitizing the silver halide grains. Compounds containing sulphur, such as allylisothiocyanate, allylthiourea and thiosulphates are particularly preferred. Noble metals such as gold, platinum, palladium, iridium, ruthenium or rhodium and compounds of these metals are also suitable as chemical sensitizers. This method of chemical sensitization is described in the article by R. Koslowsky, Z. Wiss. Phot. 46, 65–72 (1951). The emulsions may also be sensitized with polyalkylene oxide derivatives. See also the above-mentioned Research Disclosure No. 17643, Section III.

The emulsions may be optically sensitized in a known manner, e.g. with the usual polymethine dyes such as neutrocyanines, basic or acid carbocyanines, rhodacyanines, hemicyanines, styryl dyes, oxonoles and the like. Sensitizers of this kind are described by F. M. Hamer in "The Cyanine Dyes and related Compounds", (1964); see also in particular Ullmanns Enzyklopädie der technischen Chemie, 4th Edition, Volume 18, pages 431 et seq and the above-mentioned Research Disclosure No. 17643, Section IV.

The usual antifogging agents and stabilizers may be used. Azaindenes are particularly suitable stabilizers, especially the tetra- and penta-azaindenes and particularly those which are substituted with hydroxyl or amino groups. Compounds of this kind are described, e.g. in the article by Birr, Z. Wiss. Phot. 47, 1952, pages 2 to 58. Other suitable stabilizers and anti-fogging agents are mentioned in the aforesaid Research Disclosure No. 17643, Section IV. Suitable compounds for improving the formalin resistance are mentioned in U.S. Pat. No. 464,463.

The recording material may contain stabilizers to protect against visible light and UV light and improve the storage stability. These stabilizers may be present in polymeric form. Aminoallylidine malonitriles, for example, are particularly suitable stabilizers for this purpose.

The additional components of the photographic material may be incorporated by the usual, known methods. If they are water-soluble or alkali soluble compounds, they may be added in the form of aqueous solutions, if necessary with the addition of water-miscible organic solvents such as ethanol, acetone or dimethylformamide. If they are insoluble both in water and in alkalies, they may be incorporated in the recording materials as dispersions in a known manner. For example, a solution of these compounds in a low boiling organic solvent may be mixed with the silver halide emulsion, either directly or first with an aqueous gelatine solution, and the organic solvent may then be removed. The resulting dispersion of the given compounds may subsequently be mixed with the silver halide emulsion. So-called oil formers may be used in addition. These are generally relatively high boiling organic compounds in which the compounds to be dispersed are enclosed in the form of oily droplets.

See in this connection, for example, U.S. Pat. Nos. 2,322,027, 2,533,514, 3,689,271, 3,764,336 and 3,765,897. Couplers may also be incorporated, for example, in the form of loaded latices, see DE-OS No. 2 541 274 and EP-A No. 14 921. The components may also be fixed in the material as polymers, see e.g. DE-OS No. 2 044 992, U.S. Pat. No. 3,370,952 and U.S. Pat. No. 4,080,211.

The usual layer supports may be used for the materials according to the invention, e.g. supports consisting of cellulose esters such as cellulose acetate or polyesters. Paper supports are also suitable and these may be coated, e.g. with polyolefines, in particular with polyethylene or polypropylene; see in this connection the above-mentioned Research Disclosure No. 17643, Section XVII.

The usual hydrophilic film-forming agents may be used as protective colloids or binders for the layers of recording material, e.g. proteins, in particular gelatine. Casting auxiliaries and plasticizers may also be used; see the compounds mentioned in the aforesaid Research Disclosure No. 17643, Sections IX, XI and XII.

The layers of photographic material may be hardened in the usual manner, for example with epoxide type hardeners, heterocyclic ethyleneimine hardeners or acryloyl hardeners. The layers may also be hardened by the process according to German Offenlegungsschrift No. 2 218 009 to produce colour photographic materials which are suitable for high temperature processing. The photographic layers or colour photographic multilayered materials may also be hardened with hardeners of the diazine, triazine or 1,2-dihydroquinoline series or with vinylsulphone type hardners. Other suitable hardeners are disclosed in German Offenlegungschriften Nos. 2 439 551, 2 225 230 and 2 317 672 and in the above-mentioned Research Disclosure 17643, Section XI.

Other suitable additives are mentioned in Research Disclosure 17643 and in "Product Licensing Index" of December 1971, pages 107–110.

Suitable colour developer substances for the material according to the invention include in particular those of the p-phenylenediamine series, e.g. 4-amino-N,N-diethylaniline hydrochloride; 4-amino-3-methyl-N-ethyl-N-β-(methanesulphonamido)-ethyl aniline sulphate hydrate; 4-amino-3-methyl-N-ethyl-N-β-hydroxyethyl aniline sulphate; 4-amino-N-ethyl-N-(2-methoxyethyl)-m-toluidine-di-p-toluene sulphonic acid and N-ethyl-N-β-hydroxyethyl-p-phenylene diamine and mixtures thereof. Other suitable colour developers are described, for example, in J. Amer. Chem. Soc. 73, 3100 (1951) and in G. Haist, Modern Photographic Processing, 1979, John Wiley and Sons, New York, pages 545 et seq.

After colour development, the material is bleached and fixed in the usual manner. Bleaching and fixing may be carried out separately or together. The usual compounds may be used as bleaching agents, e.g. $Fe^{3+}$ salts and $Fe^{3+}$ complex salts such as ferricyanides, dichromates, water-soluble cobalt complexes, etc. Iron-III complexes of aminopolycarboxylic acids are especially preferred, in particular, for example, of ethylene diaminotetracetic acid, nitrilotriacetic acid, iminodiacetic acid, N-hydroxyethyl-ethylene-diaminotriacetic acid, alkyliminodicarboxylic acids and iron-III complexes of corresponding phosphonic acids. Persulphates are also suitable bleaching agents.

Some representative examples of the synthesis of polymer couplers according to the invention are described below.

Polymer Coupler 3

Copolymer coupler from 1-(4-methylsulphonylphenyl-3-methacrylamido-2-pyrazolin-5-one (Coupler K2), butyl acrylate and Monomer M1

0.52 g of Oleyl methyl tauride are dissolved in 100 ml of water under nitrogen and heated to 80° C. 0.3 ml of an initiator solution of 2 g of potassium peroxydisulphate in 100 ml of water and a suspension of 3.3 g of coupler K2, 4.4 g of butyl acrylate and 3.3 g of Monomer M1 in 50 ml of methanol are then both added at the same time to this solution. A further 5.2 ml of the initiator solution is added dropwise in the course of one hour and the reaction mixture is stirred for 2 hours at 80° C. The methanol is then distilled off and the solids content adjusted to 10% by weight. A finely divided latex having a residue of less than 1% of agglomerated particles is obtained.

Polymer Coupler 1

Copolymer coupler from 1-(4-methylsulphonylphenyl)-3-methacrylamido-2-pyrazolin-5-one (Coupler K2), ethyl acrylate and Monomer M13

4 g of an initiator solution prepared from 2 g of potassium peroxydisulphate and 100 ml of water and a suspension of 3.3 g of coupler K2, 1.1 g of Monomer M13 and 6.6 g of ethyl acrylate are added under nitrogen to a solution of 520 mg of oleyl methyl tauride and 100 g of water heated to 80° C. The reaction mixture is stirred for 2 hours at 80° C. and the methanol is then distilled off and the solids content is adjusted to 10%. The finely divided copolymer latex contains less than 1% of residue.

Polymer Coupler 2

Copolymer coupler from 1-(2,5-dichloro-5-cyanophenyl)-3-methacrylamido-2-pyrazolin-5-one (Coupler K25), butyl acrylate and monomer M6

0.52 g of oleyl methyl tauride is dissolved in 100 ml of water under nitrogen and heated to 80° C. 0.3 ml of an initiator solution of 2 g of potassium peroxy disulphate in 100 ml of water and a suspension of 3.3 g of Coupler K26, 1.12 g of Monomer M6 and 6.59 g of butyl acrylate in 50 ml of methanol are both added at the same time to this solution. A further 5.2 ml of the initiator solution is added dropwise in the course of one hour and the reaction mixture is stirred for 2 hours at 80° C. and the methanol is distilled off at the same time. A finely divided latex coupler having a solids content of 12% is obtained.

Polymer Coupler 4-23

The polymer couplers entered in Table 3 below are prepared from the coupler-containing Monomers K and Monomers M described above, using the same method as that described for the preparation of the copolymers in the previous Examples.

The following abbreviations are used for the comonomers M:

| | |
|---|---|
| BA | butyl acrylate |
| EA | ethyl acrylate |
| EHA | ethyl hexyl acrylate |
| MA | methyl acrylate |
| BM | butyl methacrylate |
| MBAA | methylene-bis-acrylamide |
| PAA | i-propylacrylamide |
| MAS | methallyl sulphonate. |

Table 3 also contains comparison couplers A and B which do not contain any recurrent units of a monomer M.

TABLE 3

| Polymer Coupler | Monomer K | Quantity % by wt. | Monomer M | % by weight | Comonomer C | % by weight |
|---|---|---|---|---|---|---|
| 4 | K12 | 30 | M19 | 25 | BA | 45 |
| 5 | K17 | 35 | M11 | 20 | BA | 45 |
| 6 | K20 | 28 | M17 | 30 | EA | 42 |
| 7 | K21 | 42 | M59 | 15 | BA | 43 |
| 8 | K25 | 30 | M60 | 10 | EHA | 60 |
| 9 | K9 | 30 | M67 | 45 | MA/BA | 5/20 |
| 10 | K62 | 35 | M69 | 35 | BM | 30 |

TABLE 3-continued

| Polymer Coupler | Monomer K | Quantity % by wt. | Monomer M | % by weight | Comonomer C | % by weight |
|---|---|---|---|---|---|---|
| 11 | K64 | 40 | M70 | 20 | BA | 40 |
| 12 | K66 | 32 | M56 | 30 | PAA/MBAA | 30/8 |
| 13 | K29 | 30 | M38 | 22 | BA | 48 |
| 14 | K28 | 25 | M21 | 5 | BA | 70 |
| 15 | K30 | 35 | M9 | 30 | EA | 35 |
| 16 | K34 | 35 | M6 | 15 | BM | 50 |
| 17 | K33 | 35 | M2 | 10 | EA | 55 |
| 18 | K58 | 50 | M5 | 10 | EA/MAS | 35/5 |
| 19 | K2 | 30 | M13 | 10 | BA | 60 |
| 20 | K2 | 30 | M1 | 40 | BA | 30 |
| 21 | K2 | 30 | M1 | 5 | BA | 65 |
| 22 | K2 | 30 | M1 | 10 | BA | 60 |
| 23 | K2 | 30 | M1 | 20 | BA | 50 |
| A | K2 | 30 | | — | BA | 70 |
| B | K17 | 35 | | — | EA | 65 |

EXAMPLE 1

To test the colloid stability of the polymer couplers, the samples prepared were filled into test tubes and stored at 40° C. The sedimented amount of coupler polymer was determined after 1, 3, 7 and 30 days and graded.

| Polymer coupler | Days of storage 1 | 3 | 7 | 30 |
|---|---|---|---|---|
| A (Comparison) | + | 0 | 0 | — |
| 22 | + | + | + | 0 |
| 23 | + | + | + | + |
| 3 | + | + | + | + |

+ No sedimentation
0 little sedimentation
— large amount of sedimentation

The Example shows that given the same colour coupler monomer K2 and the same comonomer, butyl acrylate, the colloid stability is improved by the incorporation of urethane groups or urea groups in the polymeric couplers.

EXAMPLE 2

The polymer couplers 19, 20 according to the invention and the polymeric comparison coupler B were added to various samples of a silver halide emulsion which had been green sensitized to conform to the colour coupler introduced. The silver halide/gelatine emulsion used consisted of 75 g of silver iodobromide (iodide content 3 mol-%) and 72 g of gelatine, based on 1 kg of emulsion.

The emulsions prepared as described above were applied to cellulose triacetate layer supports coated with bonding layer and the emulsions were dried.

Photographic test:

The individual samples were exposed by means of a sensitometer and then processed, using the following colour developers A (=Processing A) or B (=Processing B).

The relative sensitivity, gradation (γ), colour yield and stability of the colour image in storage of the processed materials treated with formalin were determined. The reduction in maximum density after one week's storage of the material at room temperature and 70% relative humidity is recorded.

Processing baths:

| | |
|---|---|
| Colour developer A | |
| Sodium metaphosphate | 2 g |
| Sodium sulphite anhydrous | 2 g |
| NaOH 10% | 5 ml |
| Sodium carbonate anhydrous | 50 g |
| Potassium bromide | 1 g |
| N—Ethyl-N—(β-methanesulphonamido)-ethyl-4-amino-3-methyl-aniline sesquisulphate | 5 g |
| Benzyl alcohol | 3 ml |
| Water up to | 1000 ml |
| pH | 10.75 |
| Colour developer B | |
| Distilled water | 800 g |
| Disodium salt of hydroxyethane diphosphonic acid | 2 g |
| Disodium salt of ethylene diaminotetracetic acid | 2 g |
| Potassium carbonate | 34 g |
| Sodium bicarbonate | 1.55 g |
| Sodium disulphite | 0.28 g |
| Sodium sulphite | 3.46 g |
| Potassium bromide | 1.34 g |
| Hydroxylamine sulphate | 2.4 g |
| N—ethyl-N—(β-hydroxy)-ethyl-4-amino-3-ethyl aniline sulphate | 4.7 g |
| Distilled water up to | 1000 ml |

Processing

| | Processing [min] A (21° C.) | B (25° C.) |
|---|---|---|
| Colour developer A | 15 | — |
| Colour developer B | — | 10 |
| Stop bath | 2 | 4 |
| Intermediate rinsing | 10 | 5 |
| Bleaching bath | 8 | 5 |
| Intermediate rinsing | 5 | 5 |
| Fixing bath | 5 | 5 |
| Final rinsing | 10 | 10 |

| Polymer coupler | Processing | E | γ | Colour yield | Loss in colour density (%) after formalin treatment |
|---|---|---|---|---|---|
| B (Comparison) | A | 97 | 0.4 | 1.65 | 62 |
| B (Comparison) | B | 94 | 0.42 | 1.33 | 59 |
| 20 | A | 76 | 1.15 | 2.58 | 28 |
| 20 | B | 83 | 0.56 | 2.30 | 31 |
| 19 | A | 75 | 1.05 | 2.54 | 17 |

-continued

| Polymer coupler | Processing | E | γ | Colour yield | Loss in colour density (%) after formalin treatment |
|---|---|---|---|---|---|
| 19 | B | 83 | 1.6 | 2.78 | 13 |

E: relative sensitivity, a reduction in the given figure by 3 units corresponds to an increase in sensitivity by 1 DIN γ: gradation Colour yield: Maximum density divided by silver application (measured in $AgNO_3$)

EXAMPLE 3

This example demonstrates that the incorporation of urea groups or urethane groups in polymeric couplers improves the absorption of dyes formed from them in the process of development and at the same time increases the colour yield.

Silver halide layers containing polymeric couplers 22 and 23 and, for comparison, coupler A and a state of the art emulsified coupler C are prepared and processed as described in Example 2. The values obtained for colour yield and absorption $\lambda_{max}$ are entered in the following Table, in which the absorption of the comparison couplers shows an undesirable shift to short wavelengths.

| Polymer coupler | Processing | Colour yield % | $\lambda_{max/nm}$ |
|---|---|---|---|
| 23 | A | 2.78 | 548 |
| 23 | B | 2.67 | 555 |
| 22 | A | 2.59 | 546 |
| 22 | B | 2.44 | 552 |
| A | A | 2.25 | 538 |
| A | B | 2.39 | 546 |
| C | A | 2.13 | 546 |
| C | B | 2.33 | 554 |

The comparison coupler C corresponds to the following formula

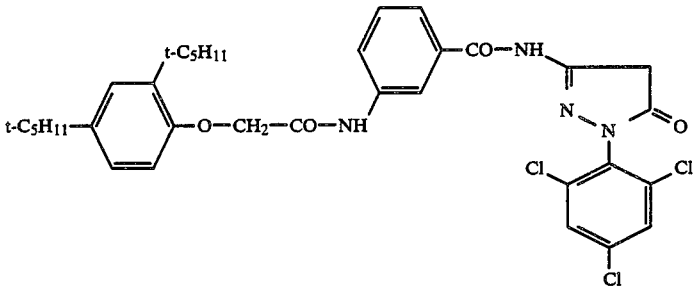

What is claimed is:

1. Light-sensitive photographic recording material comprising at least one light-sensitive silver halide emulsion layer and a polymer having recurrent units of a polymerised monomer K, which contains a coupler group, characterised by the additional presence of recurrent units of a monomer M which is different from the monomer K by not containing any coupling groups and contains at least one urethane and/or urea group wherein comonomers K and M are monomer units containing ethylenically unsaturated groups.

2. Light-sensitive photographic recording material as claimed in claim 1, wherein the monomer M corrresponds to at least one of the following formulae:

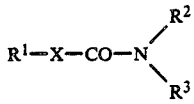

(1)

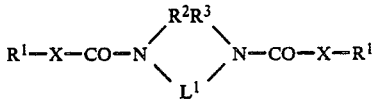

(2)

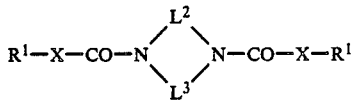

(3)

wherein

X denotes —O— or —$NR^4$—;

$R^1$ to $R^4$, which may be identical or different, denote H, optionally substituted alkyl with 1 to 20 carbon atoms, optionally substituted cycloalkyl, optionally substituted aryl, optionally substituted aralkyl or a heterocyclic group, and $R^2$ and $R^3$ may together denote the group required to form a heterocyclic group, and at least one of the groups $R^1$, $R^2$, $R^3$ and $R^4$ contains an ethylenically unsaturated group;

$L^1$ denotes optionally substituted alkylene, arylene or aralkylene with a maximum of 18 carbon atoms; and $L^2$ and $L^3$, which may be identical or different, denote optionally substituted alkylene with a maximum of 10 carbon atoms.

3. Light-sensitive photographic recording material as claimed in claim 2, wherein at least one of the groups $R^1$ to $R^4$ corresponds to or contains a group of the following formula 4

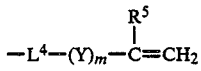

(4)

wherein $L^4$ denotes a conventional organic connecting member;

Y denotes a divalent connecting member containing at least one hetero atom;

m represents 0 or 1; and $R^5$ denotes hydrogen, alkyl or halogen.

4. Light-sensitive photographic recording material as claimed in claim 2, wherein the coupler group-containing monomer K corresponds to the following formula $$CH_2{=}C(R^{10})-B-Q \quad (5)$$

wherein $R^{10}$ denotes hydrogen, alkyl or halogen;

B is an organic connecting group of the kind commonly found in polymeric couplers; and Q denotes a coupler residue.

5. Light-sensitive colour photographic recording material as claimed in claim 2, wherein the monomer K containing the coupler group corresponds to the following formula 6

$$CH_2{=}C(R^{10})-L^{10}\text{-}(L^{11})_n(L^{12})_o-Q \quad (6)$$

wherein $R^{10}$ denotes hydrogen, alkyl or halogen;

$L^{10}$ denotes —CO—NH—, —COO—, —O— or phenylene;

$L^{11}$ denotes a conventional organic connecting member;

$L^{12}$ denotes —CO—O—, —OC—O—O, —CO—NH—, —NHCO—, —$SO_2$NH—, —NH-$SO_2$—, —NH—CO—O— or —NHCONH—;

n and o may be identical or different and represent 0 or 1; and

Q denotes a coupler residue.

6. Light-sensitive colour photographic recording material as claimed in claim 2, wherein the polymer is present in at least one light-sensitive silver halide emulsion layer.

7. Light-sensitive photographic recording material as claimed in claim 2, wherein the polymer is present in a layer which is directly adjacent to a layer containing light-sensitive silver halide but the layer containing the polymer does not contain light-sensitive silver halide.

8. Light-sensitive photographic recording material as claimed in claim 2, wherein the coupler group-containing monomer K contains a colour coupler unit.

* * * * *